United States Patent [19]

Melton

[11] 4,317,292

[45] Mar. 2, 1982

[54] SLIPPER SOCK AND METHOD OF MANUFACTURE

[76] Inventor: Florence Melton, 1000 Urlin Ave., Columbus, Ohio 43212

[21] Appl. No.: 199,447

[22] Filed: Oct. 22, 1980

Related U.S. Application Data

[62] Division of Ser. No. 100,228, Dec. 4, 1979, Pat. No. 4,276,671.

[51] Int. Cl.[3] ..... A43B 1/02; A43D 9/00

[52] U.S. Cl. ..... 36/9 R; 12/142 G

[58] Field of Search ..... 36/9 R, 10; 12/142 R, 12/142 B, 142 G, 142 C, 142 T

[56] References Cited

U.S. PATENT DOCUMENTS

| | | | |
|---|---|---|---|
| 2,586,045 | 2/1952 | Hoza | 36/9 R |
| 2,659,911 | 11/1953 | Spark | 12/142 G |
| 2,926,433 | 3/1960 | Kramer | 36/9 R |
| 3,015,170 | 1/1962 | Kramer | 36/9 R |
| 3,035,291 | 5/1962 | Bingham | 36/9 R |
| 3,863,272 | 2/1975 | Guille | 12/142 T |

*Primary Examiner*—Patrick D. Lawson

*Attorney, Agent, or Firm*—Watson, Cole, Grindle & Watson

[57] ABSTRACT

An improved slipper sock which conforms to the foot of the wearer is formed as follows: the bottom of the foot portion of a stretchable knitted sock, which is in a stretched condition on a foot form, has temporarily attached to the exposed side thereof a thin and flexible bottom sole by use of dots of adhesive located at the extremities of the heel and toe portions thereof, the knitted sock is then removed from the foot form, and the periphery of the bottom sole is then stitched to the stretched bottom of the foot portion of the knitted sock, this stitching concurrently creating a taper in the thickness of the periphery of the bottom sole.

6 Claims, 6 Drawing Figures

SLIPPER SOCK AND METHOD OF MANUFACTURE

CROSS REFERENCE TO RELATED APPLICATION

The present application is a divisional application of application Ser. No. 100,228, filed Dec. 4, 1979, now U.S. Pat. No. 4,276,671.

BACKGROUND OF THE INVENTION

1. Field of the Invention

The present invention relates to a slipper sock of the type which includes a stretchable upper portion, a stretchable foot portion, and a protective bottom sole, as well as to a method of fabricating such a slipper sock.

2. The Prior Art

Foot coverings which include stretchable upper portions, stretchable foot portions, and protective bottom soles are of course well known and are, for example, shown in detail in U.S. Pat. Nos. 3,863,272, 3,063,074, 3,032,898, 2,659,911, and 2,538,673. However, none of the prior art foot coverings are as conformable to the foot of the wearer or as comfortable to wear as the slipper socks according to the present invention. A brief summary of the teachings in these patents, as well as their deficiencies, follows.

The slipper sock according to Guille, U.S. Pat. No. 3,863,272, comprises a conventional knitted sock which has attached to the bottom of its foot portion a sole that is composed of a flexible, soft and wear-resistant material such as velvet-pile fabric, felt or tagged carpeting. A layer of plastic material is located on the face of the fabric sole in contact with the bottom of the foot portion of the sock, this plastic layer having imbedded therein the fibers of the bottom of the foot portion of the sock. The fabric sole is attached to the sides of the foot portion by way of a molded side portion composed of a plastic material such as polyvinyl chloride. In fabricating the slipper sock, the foot portion of the sock is fitted over a rigid foot-shaped forming block, the sole is placed at the bottom of a suitably-shaped cavity of a mold, the foot-shaped forming block (with sock foot portion positioned thereover) is placed within the mold, such that the bottom of the foot portion of the sock is applied against the sole, and a hot, pasty plastic material is injected into the mold, such that after cooling the noted side portion and the noted plastic layer located between the sole and the foot portion of the sock will be formed. In the embodiment of slipper sock according to Guille shown in FIGS. 7 and 8, an intercalary sole can be utilized between the foot portion of the sock and the fabric sole.

However, the slipper sock of Guille is totally different in construction from the slipper sock of the present invention (the slipper sock of the present invention includes no plastic adhesion layer connecting the entirety of the sole with the bottom of the foot portion of the sock, which adhesion layer stiffens and makes less comfortable the bottom of the foot portion of the sock, and it includes no molded side portion connecting the sole to the foot portion of the sock, which molded side portion reduces the conformability of the sock to the foot of the wearer—and thus its comfortableness), and the slipper sock of Guille is fabricated by a much different and much more complicated method as compared to that of the present invention.

The foot covering according to Scholl, U.S. Pat. No. 3,063,074, comprises a fabric slipper having an elastic upper and a cushion sole adhered to the foot portion of the fabric slipper (functional as either an insole or outsole, depending on how the fabric slipper is folded with respect to the cushion sole). The cushion sole is attached to the foot portion of the fabric slipper via a thermoplastic layer that permeates the fabric material of the fabric slipper and on the opposite surface of the cushion sole is located another layer of thermoplastic material to which is adhered a relatively thick layer of cushioning material. In fabricating the foot covering, the cushion sole is placed within a suitably-shaped opening in a form (the cushion sole having had the noted cushioning material already applied to one surface thereof), such that the thermoplastic adhesive (applied to the opposite surface) is exposed, the fabric slipper is then engaged over a foot-shaped last, the form is then heated such that the thermoplastic adhesive on the cushion sole therein is made tacky, and the last with fabric slipper thereon is then placed in the mold opening and pressed firmly upon the exposed adhesive layer on the cushion sole. Upon cooling of all the parts, the fabricated foot covering is lifted out of the form, the cushion sole being firmly bonded to the sole portion of the slipper.

The slipper sock of the present invention is totally different in construction and in method of fabrication as compared to the sock product and method of construction in Scholl, and in fact the slipper sock of the present invention, likewise in comparison to the slipper sock of Guille, is distinctly improved over that in Scholl since the use of a continuous adhesion layer between the sole and the bottom of the foot portion of the sock is completely avoided.

U.S. Pat. No. 3,032,898 to Servin shows a stretch-type slipper comprising two stitched-together knitted fabric upper portions which are connected at their bottom portions by a peripheral line of overlock stitching to a laminated sole, which itself forms the bottom of the foot portion of the slipper. The laminated sole comprises a center foam material having on one surface a knitted fabric material and on its other surface an impervious, imperforate synthetic resin layer. The noted stitching is caused to extend through the materials making up the laminated sole, through a ply of the fabric upper portions (the lowermost edges of the upper portions being folded back to create two bottom plies between which is located an elastic tension tape), and around the elastic tension tape, and back through the peripheral edges of the materials making up the laminated sole. The elastic tension tape helps to provide additional strength in holding the fabric upper portions to the laminate sole.

Although the slipper of Servin is indeed a stretch-type foot covering, its construction is much different from that of the present invention (the described slipper is not really a slipper "sock" since there is no knitted fabric bottom which is integral with the upper portions nor in a stretched condition), and its method of manufacture, whatever it is, is obviously not at all similar to that of the present invention.

Spack, U.S. Pat. No. 2,659,911, discloses a slipper sock and method for its production which includes a sock, an outer sole (made of sponge or foam) attached to the bottom wall of the foot portion of the sock by a layer of adhesive, and a welt which is adhered to the sides and peripheral portion of the sock foot portion, i.e., between the peripheral portion of the bottom wall of the sock foot portion and the outer sole. In fabricating the slipper sock, the sock is stretched over a last, the welt (having adhesive thereon) is applied to the outer longitudinal wall of the foot portion of the sock and then, after suitable applications of adhesive to the appropriate elements and suitable bending of the welt to contact the bottom wall of the foot portion of the sock, a suitably shaped and treated outer sole is pressed against the bottom wall of the sock foot portion and the welt at the periphery thereof until all the elements are firmly adhered together.

The slipper sock of the present invention, for reasons noted previously with respect to the other patents, is totally distinct in construction and method of fabrication from the slipper sock of Spack.

Finally, the footwear article of Donahue, U.S. Pat. No. 2,538,673, includes an ordinary knitted sock to which is adhered, on the bottom of its foot portion, and via a layer of cement, a sole member 14 composed, for example, of natural or synthetic sponge rubber. In forming the footwear article, a pattern is inserted into the knitted sock and the sole member, which has had one surface thereof coated with first a layer of solvent-type cement and then a coating of latex-type rubber cement, is pressed against the outside of the bottom of the foot portion of the sock (which is supported internally by the pattern) sufficiently that the cement permeates the fibers of the sock fabric. The cement is allowed to partially set, and then the sock and attached sole are subjected to a great pressure, which then causes the cement to spread substantially laterally through the fibers of the sock, such that once dried, the cement will firmly grip and hold the fibers of the outwardly extending loops of the sock fabric.

The slipper sock of the present invention, for reasons noted previously with respect to the other patents, is totally distinct in construction and method of fabrication from the slipper sock of Donahue.

SUMMARY OF THE PRESENT INVENTION

The slipper sock of the present invention, which is not only extremely comfortable to wear, light in weight and fully washable, but also very durable, comprises a stretchable knitted sock which includes an upper portion and an integral foot portion, and a bottom sole attached at only its periphery of the exposed side of the bottom of the foot portion. The bottom sole may be composed of a single layer of a thin, flexible material which is slip resistant and, optionally, waterproof, or it may optionally be combined with a layer of cushioning material to form a laminate that can be used instead of the noted single layer. When used by itself, the bottom sole is attached at its periphery to the bottom of the foot portion of the stretchable knitted sock by stitching such that the bottom sole becomes tapered in thickness at its edges, thus creating a slipper sock product which will be readily comformable to the shape of the wearer's foot, and thus very comfortable in feel, i.e., as would be the original knitted sock without use of the added bottom sole. An entire layer of adhesive between the bottom sole and the bottom of the sock foot portion, which diminishes the elasticity of the yarn forming the bottom of the sock foot portion, is strictly avoided, as is the use of one or more peripheral molded side strips adhesively connecting the bottom sole to the sides of the sock foot portion, these side strips actually reducing the conformability of the sock to the foot of the wearer.

The method of producing the slipper sock of the present invention involves the use of varying size foot forms that can be used to form an inventive slipper sock to the foot size of almost any sized foot, while using, e.g., a source of single sized stretchable knitted socks. The appropriate foot form is first selected, and the knitted sock is then placed over the foot form, the stretchability of the knitted fabric allowing the foot portion of the sock to conform to the size and shape of the foot form. A bottom sole is then taken (when used by itself), and by use of suitable temporary attachment means, is attached at the extremities of its heel and toe portions to the bottom of the foot portion of the sock in its stretched condition on the foot form. The attachment means can take the form of a dot of adhesive, a staple, or any other suitable means creating a relatively small, temporary and isolated attachment between the bottom sole and the bottom of the foot portion of the sock for positioning of the bottom sole. Then the sock and attached bottom sole is removed from the foot form, and the sock is then suitably positioned on either a conventional cylinder-type sewing machine or a conventional Post machine, whereupon the bottom sole is then stitched along its periphery to the outer edge of the bottom of the foot portion of the sock, while the bottom is being simultaneously stretched, such that the periphery of the bottom sole will become tapered in thickness. Only in this way can the sock, with the bottom of the foot portion in its stretched condition, be formed with the proper sole size while retaining its initially soft shape. Once the sewing is completed, the slipper sock is removed from the sewing machine, and it will be ready for immediate use. If staples are used to temporarily attach the bottom sole to the foot portion of the sock, they are of course removed after the sewing of the bottom sole to the foot portion is completed. If the bottom sole is combined with a cushioning layer to form a laminate, the cushioning layer will be the one on which the attachment means, e.g., dots of adhesive, will be applied.

The inventive slipper sock is much improved in characteristics over the slipper socks of the prior art.

The invention will now be better understood by reference to the accompanying drawings, taken in conjunction with the following discussion.

DETAILED DESCRIPTION OF THE PREFERRED EMBODIMENTS

Figure 1:
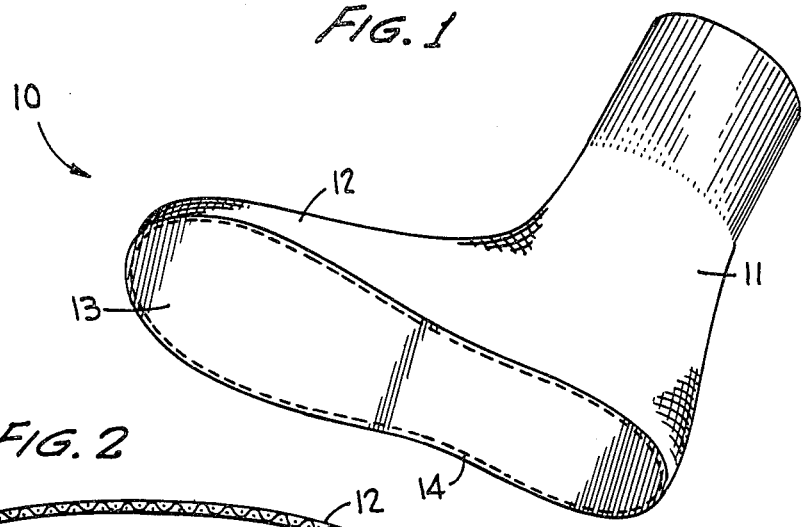
FIG. 1 shows a perspective view of a slipper sock constructed in accordance with the present invention.

As can be easily seen from a review of FIG. 1, the stretchable slipper sock 10 of the present invention includes a knitted upper portion 11, a knitted foot portion 12 and a bottom sole 13 which is attached to the bottom of the foot portion 12 via stitching around its periphery, such stitching being generally indicated by 14. As can be seen from FIG. 2, the foot portion 12 of the slipper sock includes a bottom 12*a* which is integral with the remainder of the foot portion as depicted in FIG. 1.

Figure 2:
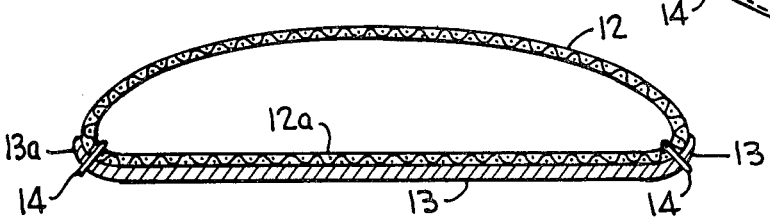
FIG. 2 shows a cross-sectional view of the foot portion of one embodiment of a slipper sock constructed in accordance with the present invention.
Figure 3:
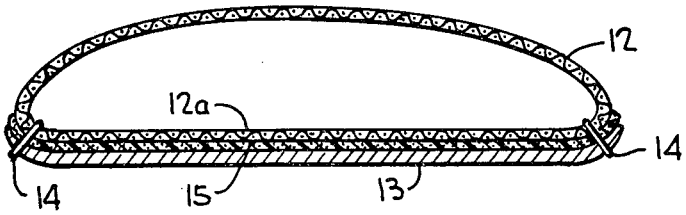
FIG. 3 shows a cross-sectional view of the foot portion of another embodiment of a slipper sock constructed in accordance with the present invention.

The stitching of the bottom sole, which is depicted in FIG. 2 as comprising a single layer of a thin sole material, to the stretched bottom 12*a* of the foot portion 12 causes the bottom sole 13 to become tapered in thickness at its periphery—see 13*a* and 13*b* in FIG. 2—and this feature causes the foot portion to remain extremely conformable to the foot of the user. This same result can be obtained even when the noted bottom sole is combined with a layer of cushioning material 15, such as a layer of polyurethane, so as to form a composite laminate. In this instance, and as shown in FIG. 3, the cushioning layer will be located between the thin sole material 13 and the bottom 12*a* of the foot portion of the sock.

Figure 4:
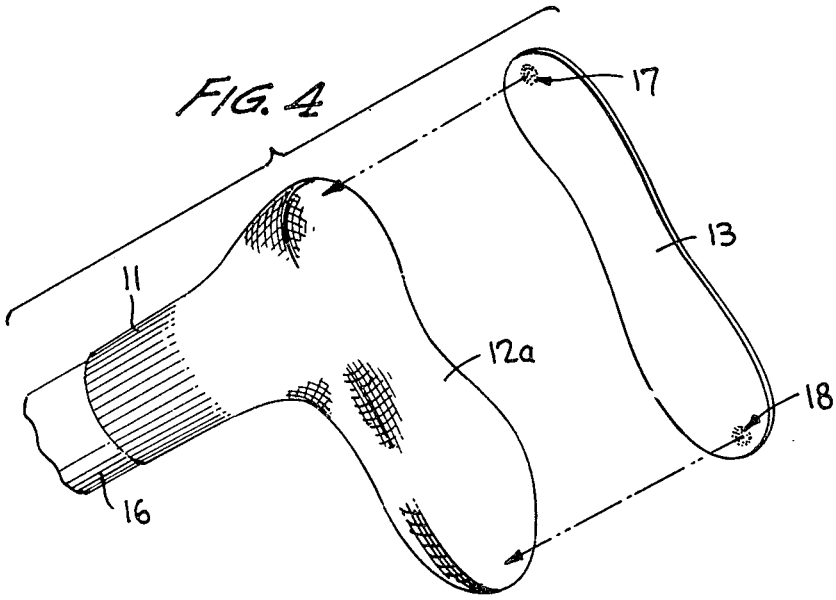
FIG. 4 shows a perspective view of both a knitted sock in its stretched condition over one type of suitable foot form and a bottom sole having dots of adhesive located at the extremities of its heel and toe ends, the bottom sole being ready for attachment to the stretched bottom of the sock foot portion, this figure representing a step in one embodiment of the method of making the slipper sock in accordance with the present invention.

FIG. 4 shows one point in the course of making the inventive slipper sock in accordance with one embodiment of the method of the invention: the sock has been placed over a suitably sized foot form (depicted as a last 16, although a flat form could also be used) so as to have at least its foot portion in a stretched condition, and the bottom sole 13, shown as a single layer of sole material, has had two dots of adhesive 17 and 18 placed on the extremities of the heel and toe portions thereof, respectively, such that once the bottom sole is placed in contact with and pressed against the stretched bottom 12*a* of the foot portion of the sock (in a process indicated by the arrows in FIG. 4), the bottom sole can be at least temporarily attached thereto, i.e., while the foot portion of the sock is in its stretched condition.

Figure 5:
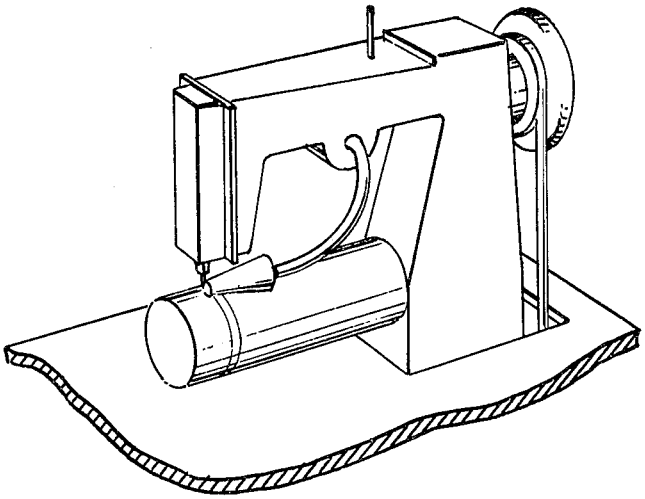
FIGS. 5 and 6 show conventional sewing machines which are used in making the slipper socks of the present invention, FIG. 5 depicting a conventional cylinder machine and FIG. 6 depicting a conventional Post machine.
Figure 6:
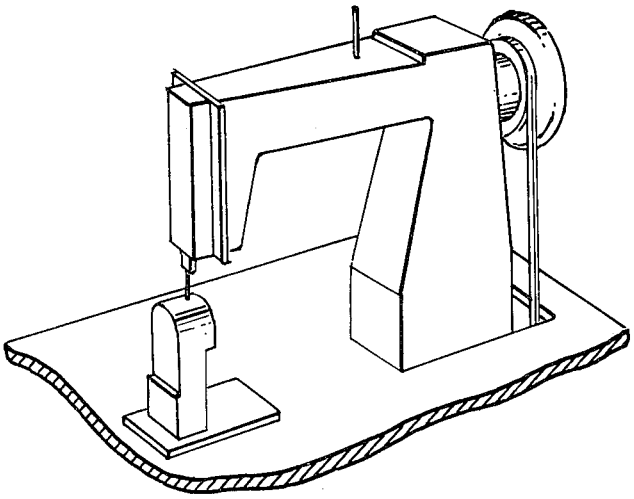

Once the bottom sole has been attached to, and thus positioned with respect to, the bottom of the sock foot portion, and once the sock has been removed from the foot form, the sock is then placed on a suitable sewing machine, e.g., opened up and suitably positioned on the cylinder of a cylinder machine or the post of a Post machine (see FIGS. 5 and 6), such that the bottom sole faces up, and an operator, while stretching the sides of the bottom of the foot portion of the sock, will sew (stitch) the periphery of the bottom sole to the bottom of the sock foot portion, i.e., while the bottom of the sock foot portion is stretched to achieve the size of the bottom sole. Once this stitching is finished, the knitted sock is removed from the sewing machine and is ready for immediate use.

It should be noted that the stretchable slipper sock of the present invention has many uses: it can be used as a bed sock for the elderly or infirm who may not only wish to wear the slipper socks to bed and enjoy their warmth, but also to provide a slipper with insulating and slip-resistance properties in the event the wearer must leave his or her bed during the night; it can be used as a protection device by people having a bandaged foot or ankle since the slipper sock is capable of stretching over the bandaging, yet provide a lightweight and durable protector; etc. If the slipper socks are to be used in damp conditions, the bottom sole can be composed of a waterproof material, and the bottom sole, if desired, can be augmented with the use of a padded material. Suitable bottom sole materials include sueded or leather-like materials, flocked materials (e.g., fabrics flocked with nylon or cotton), or in fact any suitable conventional materials that would be washable and flexible, as well as abrasion and skid-resistant, and, optionally, waterproof.

It goes without saying that, if desired, the stretchable slipper sock can be worn by the wearer inside of a shoe.

Although the invention has been described with respect to one embodiment of a method of manufacture, it can be readily appreciated that various production methods can be employed and still be within the scope of the presently claimed invention.

I claim:

1. A stretchable slipper sock which conforms to the shape of the wearer's foot and is washable, said sock comprising:

a knitted stretchable sock which includes an upper portion and a foot portion, said foot portion having a unitary stretched bottom; and a thin, flexible bottom sole having a shape and size corresponding to the shape and size of the stretched bottom of said foot portion of said knitted sock, said bottom sole being stitched around its periphery to said stretched bottom of said sock foot portion, such that said bottom sole has a tapered periphery.

2. The stretchable slipper sock in accordance with claim 1 wherein said bottom sole is composed of a flocked fabric material which is not only flexible and washable, but abrasion resistant and skid resistant.

3. The stretchable slipper sock in accordance with claim 1 wherein said bottom sole is composed of a suede or leather-like material.

4. The stretchable slipper sock in accordance with claim 1 wherein said thin, flexible bottom sole is laminated together with a layer of a cushioning material, said layer of cushioning material being located between said thin, flexible bottom sole and said stretched bottom of said foot portion of said sock.

5. The stretchable slipper sock in accordance with claim 4 wherein said layer of cushioning material comprising a layer of polyurethane.

6. The stretchable slipper sock in accordance with claim 1 wherein the small dot of adhesive connects the extremeties of the heel and toe portions of said bottom sole to the stretched bottom of said sock foot portion, no layer of adhesive being employed to connect the entirety of said bottom sole to the entirety of said stretched bottom of said sock foot portion.

* * * * *